US008025855B2

(12) United States Patent
Kuhlow et al.

(10) Patent No.: US 8,025,855 B2
(45) Date of Patent: Sep. 27, 2011

(54) SEMEN CONTAINER WITH SPECIALIZED TIP

(75) Inventors: Darin R. Kuhlow, Clinton, WI (US); Judy A. Morris, Delavan, WI (US)

(73) Assignee: Continental Plastic Corp., Delevan, WI (US)

( * ) Notice: Subject to any disclaimer, the term of this patent is extended or adjusted under 35 U.S.C. 154(b) by 406 days.

(21) Appl. No.: 12/179,758

(22) Filed: Jul. 25, 2008

(65) Prior Publication Data

US 2010/0021350 A1 Jan. 28, 2010

(51) Int. Cl.
*B01L 3/02* (2006.01)

(52) U.S. Cl. ..... 422/525; 422/524; 422/521; 422/550; 422/549

(58) Field of Classification Search ..... 422/102, 422/99, 525, 524, 521, 550, 549; 600/35, 600/33

See application file for complete search history.

(56) References Cited

U.S. PATENT DOCUMENTS

| | | | | |
|---|---|---|---|---|
| 5,006,117 | A | 4/1991 | Cassou | |
| 5,029,738 | A | 7/1991 | Dillon | |
| 5,290,259 | A * | 3/1994 | Fischer | 604/218 |
| 5,577,636 | A | 11/1996 | Fukuoka et al. | |
| 5,899,848 | A | 5/1999 | Haubrich | |
| 6,071,231 | A | 6/2000 | Mendoza et al. | |
| 6,076,712 | A | 6/2000 | Esber et al. | |
| 6,244,467 | B1 | 6/2001 | Lewit | |
| 6,527,703 | B2 | 3/2003 | Simmet | |
| 6,551,819 | B1 | 4/2003 | Simmet | |
| 2007/0228073 | A1 | 10/2007 | Mazzarino | |

FOREIGN PATENT DOCUMENTS

DE 20002609 U1 5/2000

* cited by examiner

*Primary Examiner* — Natalia Levkovich
(74) *Attorney, Agent, or Firm* — Boyle Fredrickson, S.C.

(57) ABSTRACT

A semen container fitted with a specialized tip includes a substantially hollow body having a sealable first end adapted for the introduction of biological fluids such as semen and a second end having a nozzle molded thereto. The nozzle terminates in a removable tip that is anchored to the container by way of a tab such that after dispensing the biological liquid from the container the tip and the container may be disposed of simultaneously thereby reducing or eliminating the need to separately collect the removed tips from the ground.

18 Claims, 4 Drawing Sheets

SEMEN CONTAINER WITH SPECIALIZED TIP

BACKGROUND OF THE INVENTION

1. Field of the Invention

The present invention relates in general to the field of animal husbandry. More particularly, the present invention relates to a container for the collection of biological liquids such as semen. Specifically, a preferred embodiment of the present invention relates to semen container having a specialized tip that is adapted to be retained in connection with the container after removal for dispensing the stored biological materials such that the container and tip may be disposed of simultaneously.

2. Discussion of the Related Art

Artificial insemination (AI) is a common technique employed for the purpose of procreation of a variety of different livestock. In particular, AI is used to deliver biological liquids, i.e., semen, to the reproductive tract of a female animal. Typically, these biological liquids are stored in sealed containers such as tubes and bags prior to their use.

As is known to those skilled in the art, AI technology has made it possible to inseminate a larger number of livestock than through traditional mating. Further, AI technology has made it possible to collect semen from a male animal without contact with the female. Accordingly, this allows for the insemination of each female with a controlled quantity of semen in an isolated environment such that the chances of insemination and size of resulting litter are greatly increased. The containers traditionally used to collect the semen generally include a sealable first end for the introduction of semen and a second end having a nozzle ending in a removable tip for the dispensing of the stored semen during AI. The removable tips are generally small plastic caps that may be removed by a variety of mechanisms. For example, the tips may be twisted, cut, or otherwise severed from the end of the nozzle. Typically, after the tips are removed they simply fall to ground where they pose a threat to the environment. Furthermore, the plastic tips are capable of damaging or otherwise interfering with the operation of farming machinery, e.g., mechanical barn cleaners or manure spreaders. Thus, one previously recognized problem has been that the removable tips, if not properly disposed of, may clog or otherwise plug manure spreading equipment and result in a large number of relatively small plastic pieces which are difficult to remove and dispose of. Needless to say, it is desirable to provide a semen container that employs a tip that is separable from the nozzle for dispensing of the semen during the AI procedure but that is capable of remaining attached to the container itself such that the container and tip may be disposed of simultaneously after completion of the procedure. What is needed therefore is a semen container having a specialized tip configured to maintain the tip in contact with the container after removal thereof.

The below-referenced U.S. patents disclose embodiments that were at least in-part satisfactory for the purposes for which they were intended. The disclosures of all the below-referenced prior United States patents, in their entireties are hereby expressly incorporated by reference into the present application for purposes including, but not limited to, indicating the background of the present invention and illustrating the state of the art.

U.S. Pat. No. 5,961,503 discloses a boar semen collection bag comprising a pair of flexible flat plastic segments sealed along the edges to present an upwardly opening bag. A pouch is positioned within the collection bag. When the bag is disposed within a collection mug, the upper portions thereof extend as a shroud around the exterior of the mug. Once the semen is received within the mug, the semen passes through a filter material and into the collection bag. The collection bag includes a spout having a tip that is cut off to form a dispensing opening in the spout for dispensing the contents thereof.

U.S. Pat. No. 6,551,819 discloses a container for semen and other biological liquids for use in AI. The container includes a nozzle for the delivery of the biological liquid. The nozzle includes means for bending such that the container may be used in a vertical position while attached to a horizontal catheter. Further, the nozzle has means to allow for opening the nozzle, i.e., removing a tip thereof, without the use of tools.

In embodiments disclosed in the above-referenced patents, semen and biological liquid containers are disclosed as having nozzles with removable tips. As indicated above, these containers suffer from the disadvantage of creating a substantial amount of difficult to dispose of and potentially hazardous plastic debris. Accordingly, as noted previously, providing a biological liquid container having means to maintain a connection between the removable tip and the container is desired.

SUMMARY AND OBJECTS OF THE INVENTION

By way of summary, the present invention is directed to a semen container having a specialized tip. An effect of the present invention is to allow for simultaneously disposal of the removable tip along with the semen container. A primary object of the invention is to provide a semen container including a removable tip that is interconnected with the semen container such that it is retained in contact therewith after removal of the tip from the nozzle. Another object of the invention is to provide a semen container that is reliable, thereby decreasing down time and operating costs. Another object of the invention is to provide semen container that has one or more of the characteristics discussed above but which is relatively simple to manufacture and assemble using a minimum of equipment. Another object of the invention is to provide a semen container that can be used with existing automatic semen container filling equipment. Yet another object of the present invention is to provide a specialized tip that is capable of use with a plurality of interconnected semen bags In accordance with a first aspect of the invention, these objects are achieved by providing a semen container having a first sealable end adapted to receive the semen or biological liquid. The container includes a second end opposite the first end having a nozzle extending therefrom and terminating in a removable tip. The removable tip may be configured to be removed by cutting, twisting or otherwise severing the connection between the tip and the nozzle such that the semen or biological liquids stored in the container may be dispensed for purposes of artificially inseminating livestock. The tip is anchored or otherwise affixed to a portion of the body of the container by a plastic tab or similar such structure. Accordingly, even after the tip is removed from the nozzle, the tip remains attached to the semen container such that it may be simultaneously disposed of along with the container. In one embodiment, the specialized tip may be used with a plurality of interconnected semen bags of the kind generally known in the art.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
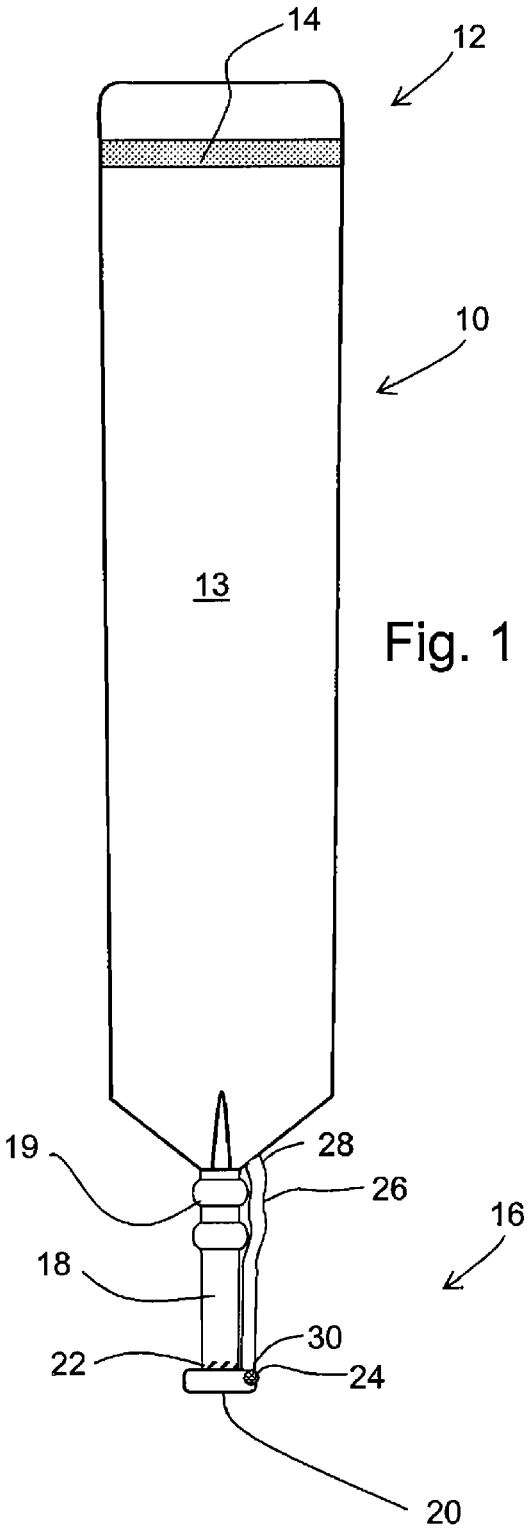
FIG. 1 is a top plan view of a semen container of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

Figure 2:
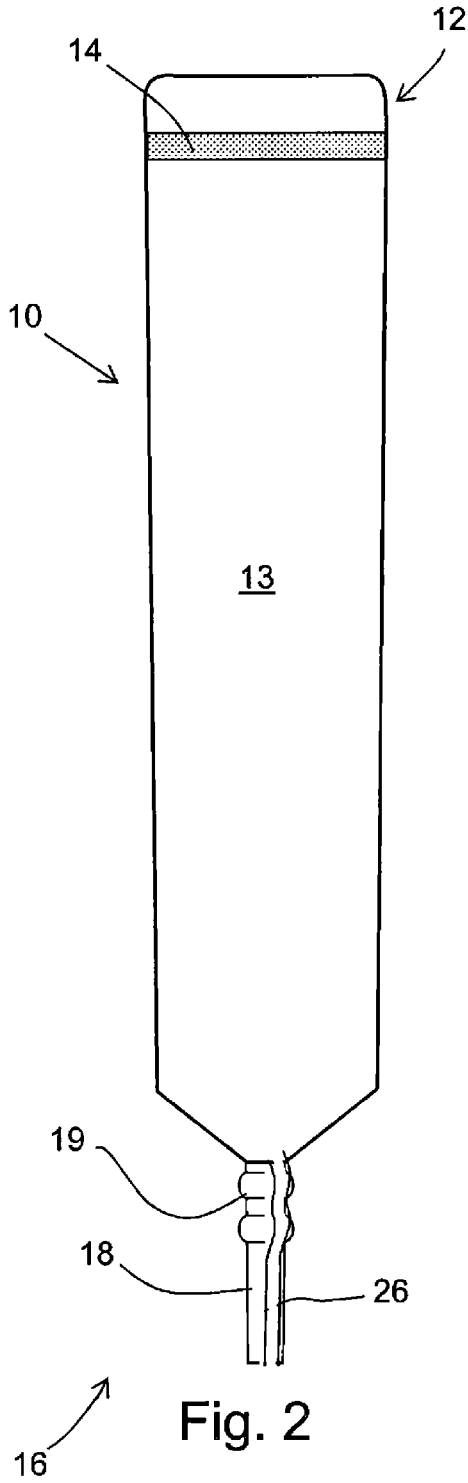
FIG. 2 is a side view of the semen container of FIG. 1.
Figure 3:
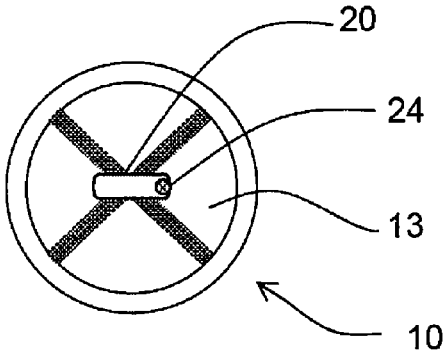
FIG. 3 is a top plan view of a top of the semen container of FIGS. 1-2.

Referring now to the drawings, and initially to FIGS. 1-3, a container for holding and storing biological liquids such as semen comprises semen tube 10 having a hollow body 13 defining a cavity and having a first end 12 adapted for receiving semen and other biological liquids to be stored in the cavity. After the semen is introduced into the tube 10, first end 12 is sealed to prevent the spilling or loss of semen therefrom. Heat sealing, or a similar such process, is preferably used to form a seal 14 at the first end 12 of the tube 10. In addition, a cut may be provided in the tube 10 along the seal 14 to facilitate the opening of the seal 14 during the AI procedure to create a vacuum inside the tube 10 to facilitate the delivery of the semen to the animal.

The walls of the tube 10 are preferably relatively flexible and adapted for receiving and retaining semen within the tube 10. As such, the tube 10 is preferably constructed from a plastic material such as, for example, polypropylene, polyvinyl chloride, or a similar such material. The tube 10 is preferably constructed from a material that will not harm or otherwise damage the contents stored within the tube 10 and which will serve to properly preserve the liquids stored therein. More preferably, the tube 10 of the present invention may be constructed of a biodegradable plastic material such that tube tips accidentally disposed of in, for example, manure pits, are safely and easily decomposed over time thereby preventing clogging or other such damage when the manure pits are pumped out.

Opposite the first end 12, a second end 16 includes a nozzle 18 attached thereto and terminating in a removable tip 20. The nozzle 18 is preferably integrally molded to the body 13 by blow molding or similar such process as is generally known in the art. The second end 16 of the tube 10 is preferably substantially more rigid than the first end 12 to facilitate delivery of the stored semen during the AI procedure. During an AI procedure, the nozzle 18 is inserted into a horizontal insemination catheter that has been inserted into the animal's body. Insertion of the nozzle 18 into the catheter is accomplished with the semen tube 10 in a substantially horizontal position and the nozzle 18 longitudinally aligned with the tube 10. The tube 10 may be rotated vertically for dispensing the stored semen. Accordingly, the nozzle 18 may additionally include a substantially bendable portion 19. The bendable portion 19 enables the tube 10 to be rotated vertically without kinking or otherwise damaging the nozzle 18 or the body 13 of the semen tube 10. Bendable portion 19 preferably includes a pair of bumps molded into the nozzle 18 to allow for bending of the nozzle 18. In addition, the nozzle 18 is preferably adapted to fit existing semen fill cup manufacturing assemblies.

The nozzle 18 is generally adapted for delivering the stored semen to the animal during the AI procedure. For example, the tip 20 of the nozzle 18 preferably includes means for easy removal therefrom. Preferably, the tip 20 is removable from the nozzle 18 without the use of tools. For example, the tip 20 and nozzle 18 may include a relatively weak portion disposed between the tip 20 and the nozzle 18 that may be easily broken such that the tip 20 may be easily removed. Alternatively, the tip 20 may include a flange 24 or similar such projection extending therefrom that may facilitate gripping by the user such that the tip 20 may be twisted or otherwise removed from the nozzle 18 under a user applied force. In one embodiment, the nozzle 18 includes a score line 22 configured to separate the tip 20 from the nozzle 18. Score line 22 is preferably provided to provide a relatively weakened line between the nozzle 18 and the tip 20 such that bending across the score line 22 allows for easy removal of the tip 20. In another embodiment, the tip 20 of the nozzle 18 is adapted to be removed by cutting with a scissors, knife, or similar such tool.

Figure 4A:
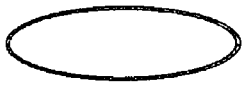
FIG. 4A is a cross-sectional view of the semen container of FIG. 4.
Figure 4:
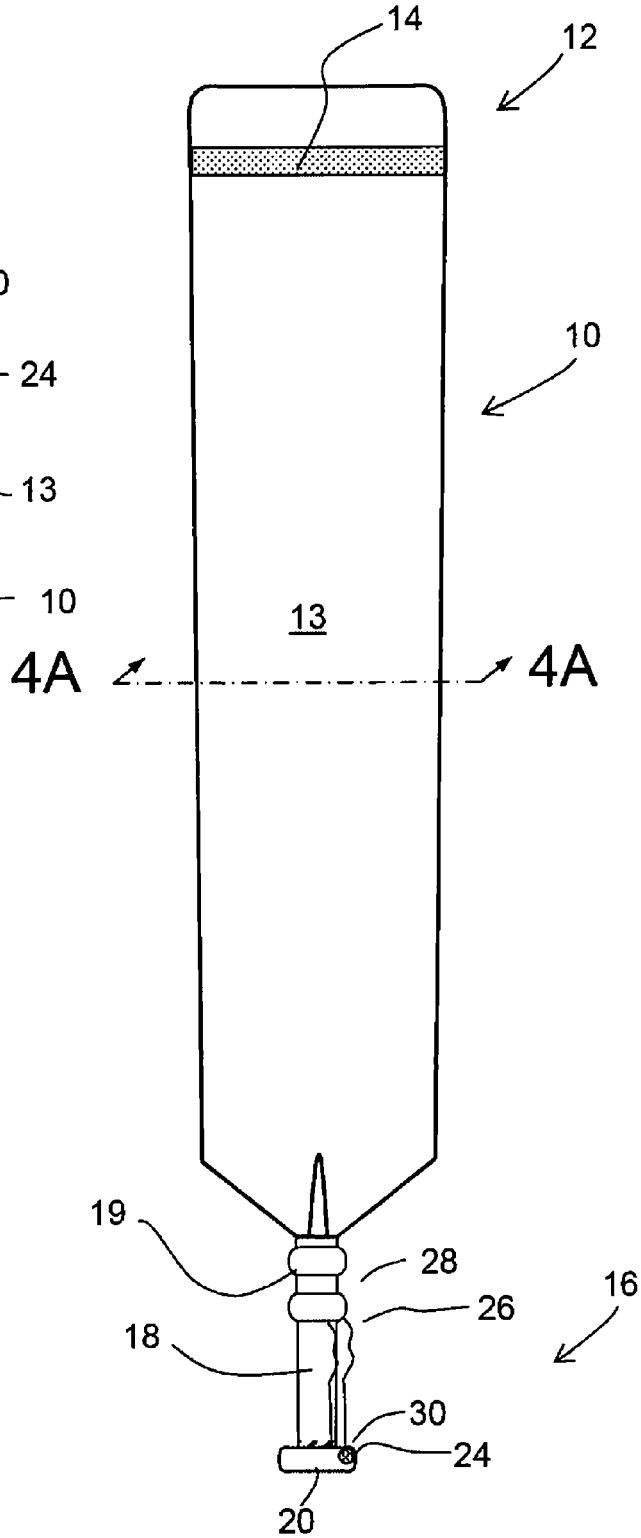
FIG. 4 is a top plan view of the semen container of the present invention.

Tip 20 preferably includes a flange 24 extending outwardly therefrom. Flange 24 provides an attachment surface for a tab 26. Tab 26 is a relatively flexible member provided in parallel with the nozzle 18 of the present invention. Tab 26 preferably has a first end 28 integrally molded or otherwise affixed to the body 13 of the tube 10 and a second end 30 molded or affixed to the flange 24 of the tip 20. The tab 26 is preferably attached to the body 13 at or near the point where the nozzle 18 extends from the body 13. In this embodiment, the tab 26 is substantially parallel to the nozzle 18. Alternatively, the tab 26 may be attached to the nozzle 18 of the body 13 as shown in FIG. 4. Thus, the tip 20 may be removed from the nozzle 18 as described above, but remain attached to a portion of the body 13 of the tube 10 by way of the tab 26. Accordingly, during an AI procedure, the tip 20 may be removed for dispensing the semen stored therein, and after completion of the procedure, the tube 10 and tip 20 may simultaneously be disposed of. As such, the amount of small plastic debris to be disposed of is greatly reduced or eliminated. Accordingly, farming equipment may safely be used to clean a barn and dispense barn waste.

Figure 5:
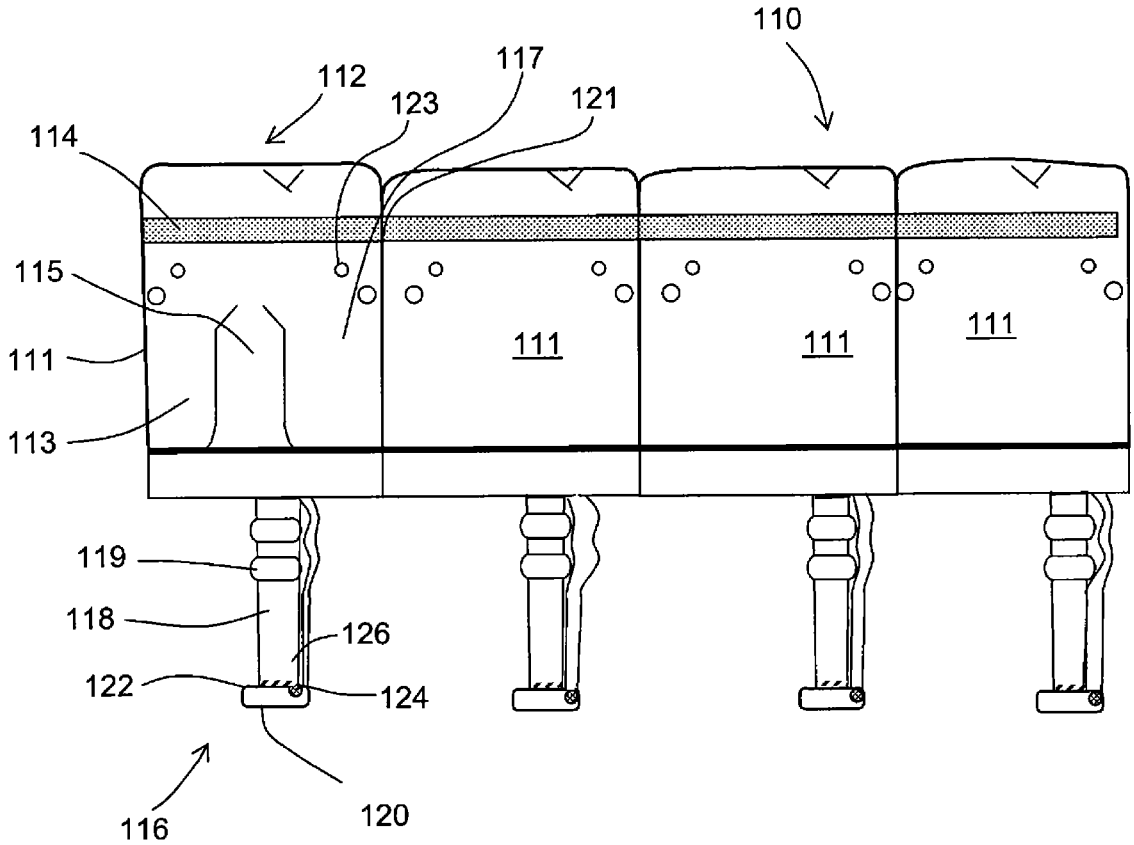
FIG. 5 is a top plan view of a semen container assembly of the present invention.

Referring now to FIG. 5, an alternative embodiment of the present invention comprising a semen bag assembly 110 includes a plurality of individual bags 111 attached to one another. Each bag 111 includes a rectangular-shaped body 113 that is relatively flat before the introduction of semen to the bag 111 and a first end 112 adapted to receive semen. The bag 111 includes an internal pouch 115 defining a cavity configured to receive the semen and secured between a joining portion 117 on each side. Joining portion 117 includes a seal 121 disposed between each joining portion 117 and a joining portion 117 of an adjacent bag 111. After the bag 111 is filled, a seal 114 may be provided at the first end 112 to securely retain the semen therein for transport or storage. The bags 111 may be sealed using heat sealing or similar such methods known in the art. In addition, each bag 111 may further include a cut or similar perforation for removing each bag 111 from the bag assembly 110. Each bag 111 preferably includes two pairs of holes 123 disposed near the first end 112 and adapted to receive hooks of a semen bag filling assembly of the kind generally known in the art. Bags 111 are preferably constructed of a plastic material, and more preferably, bags 111 are constructed of a biodegradable plastic such that the tips 120 might naturally decompose over time.

Opposite the first end 112, a second end 116 includes a nozzle 118 with a removable tip 120. The nozzle 118 is preferably heat sealed in place at the second end 116 of the bag 111 and in communication with the internal pouch 115 of the bag 111. The nozzle 118 is adapted for use with standard filling equipment known in the art. The nozzle 118 is generally adapted for dispensing stored semen in the bag 111 to an animal during an AI procedure. During use, the nozzle 118 is typically interconnected with a catheter inserted into the animal for insemination. The semen is then dispensed via the nozzle 118 under pressure applied to the bag 111 to the catheter for delivery to the animal. Nozzle 118 preferably includes a substantially bendable portion 119 similar to that of the previous embodiment.

The tip 120 is preferably removable from nozzle 118 without the use of tools. Accordingly, a score line 122 may be included to demark and separate the nozzle 118 from the tip 120. As such, the tip 120 may be easily removed by applying torque or other such force thereto. Alternatively, the tip 120 may be removed by cutting with a knife or scissors.

As in the previous embodiment, the tip 120 includes a flange 124 molded thereto. A tab 126 is interconnected between each bag 111 and the flange 124 of the tip 120. As such, when the tip 120 is removed from the nozzle 118, the tip 120 remains affixed to the bag 111 by way of the tab 126. Accordingly, the tip 120 may be disposed of along with the bag 111 after completion of the AI procedure. In an alternative embodiment, the tab 126 may comprise a thread embedded within the body 113 of bag 111 or otherwise fixed thereto. The thread of the alternative embodiment preferably comprises a relatively strong material such that the tab 126 is able to retain the tip 120 in contact with the body 113 of the bag 111 as discussed previously.

Figure 6:
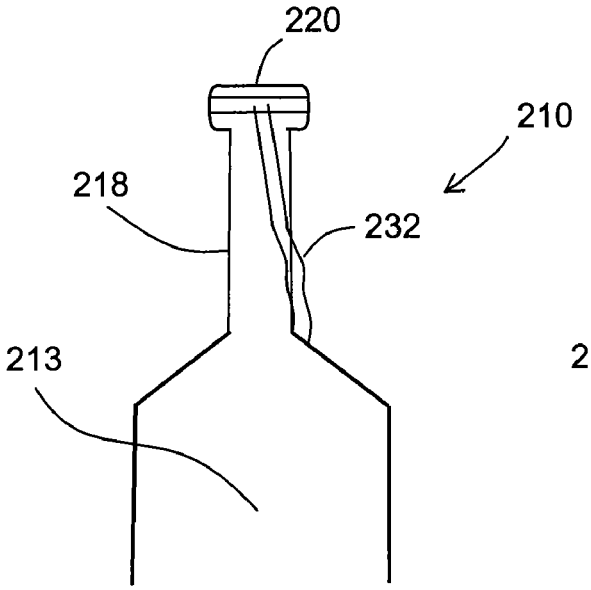
FIG. 6 is a partial top plan view of a semen container of an another embodiment of the present invention.
Figure 7:
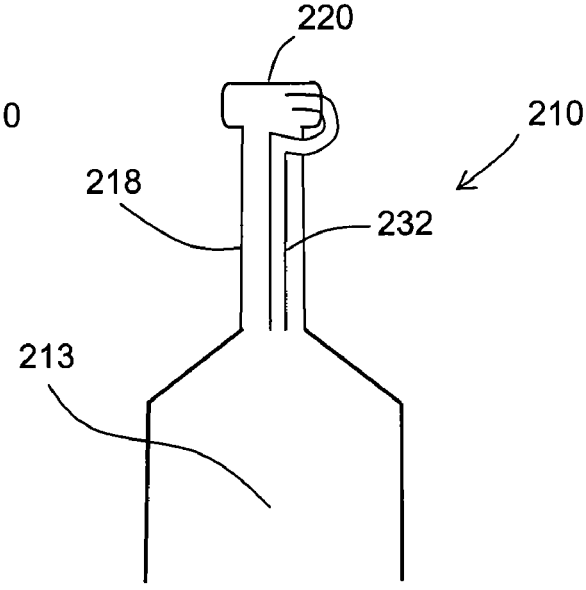
FIG. 7 is a partial top plan view of the semen container of FIG. 6.

Turning now to FIGS. 6 and 7, an alternative embodiment of the semen container 210 of the present invention includes a hollow body 213 with a nozzle 218 terminating in a removable tip 220 at one end thereof. In this embodiment, the tip 220 is retained in contact with the body 213 or nozzle 218 by way of a thread 232 embedded within the body 213 or nozzle 218. Accordingly, after the tip 220 is removed from the nozzle 218 as described in the prior embodiments of the present invention, the thread 232 ensures that the tip 220 is retained in contact with one of the body 213 and the nozzle 218. The thread 232 of this embodiment preferably comprises a relatively strong material such that the thread 232 is able to retain the tip 220 in contact with the body 213 of the container 210. Accordingly, the thread 232 may be constructed from any such suitable material including, but not limited to, a relatively flexible plastic or similarly suitable material.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A biological liquid container comprising:

a body having a first end defining a sealable opening configured to receive a biological liquid therethrough, second end opposite the first end, wherein the second end is tapered with respect to the first end, and a cavity for receiving the biological liquid disposed between the first end and the second end;

a nozzle attached to the second end and in communication with the cavity to selectively dispense the biological liquid, and including a bendable portion delimited by two bumps spaced from one another along the length of the nozzle, circumferentially disposed about the nozzle, and extending outwardly therefrom to enable the body to be oriented vertically while the nozzle is substantially horizontally oriented so as to engage a horizontally extending insemination device, wherein the bendable portion of the nozzle defines a first external diameter and the two bumps define a second external diameter that is larger than the first external diameter;

tip integrally formed with the nozzle and selectively removable therefrom; and a tab connecting the body and the tip, wherein the tab is connected to the body at the tapered second end;

wherein upon removal of the tip from the nozzle, the tip remains attached to the tab and the tab remains attached to the body.

2. The biological liquid container of claim 1, further comprising a score line defining a line of separation between the nozzle and the tip.

3. The biological liquid container of claim 2, wherein the score line is configured to enable removal of the tip, and wherein the body is an elongate body.

4. The biological liquid container of claim 1, wherein the nozzle is configured to fit into an existing filling cup.

5. The biological liquid container of claim 1, wherein the tab is a thread embedded within the body thereof.

6. The biological liquid container of claim 1, wherein the tip includes a flange configured for gripping by a user to facilitate twisting of the tip with respect to the nozzle for removal of the tip from the nozzle.

7. The biological liquid container of claim 1, wherein the tip is removable from the nozzle by cutting a portion of the nozzle, and the tip is made of a biodegradable plastic.

8. The biological liquid container of claim 1, wherein the container is connected to a plurality of other containers to form a semen bag assembly.

9. A biological liquid bag assembly comprising;

a plurality of connected bodies each having:

a sealable first end for the introduction of biological liquid, a second end opposite the first end, the second end being tapered with respect to the first end and having a nozzle having a first external diameter, the nozzle ending in a removable tip and including a pair of bumps having a second external diameter that is larger than the first external diameter, the bumps being spaced from one another along the length of the nozzle to define a bendable portion between the pair of bumps and between at least one bump of the pair of bumps and an end of the nozzle to thereby enable the nozzle to bend horizontally without kinking while the body is oriented substantially vertically so as to dispense the biological liquid through the nozzle under gravity, and a cavity between the first and second ends, wherein the bodies are connected to one another along a seam extending along at least one side thereof and integrally formed therewith; and a tab connected to the tip and the respective tapered second end of the body;

wherein the tip remains connected to the tab after removal of the tip from the nozzle.

10. The biological liquid bag assembly of claim 9, wherein each of the plurality of connected bodies is separable from the assembly.

11. The biological liquid bag assembly of claim 8, wherein the removable tip includes a portion that is reattachable to an opening defined by the nozzle.

12. The biological liquid bag assembly of claim 9, wherein each sealable first end includes a cut to facilitate opening of the respective first end.

13. The biological liquid bag assembly of claim 9, wherein each removable tip is separated from the respective nozzle by a score line configured to allow for removal of the removable tip from the nozzle.

14. The biological liquid container of claim 1, wherein the second end of the body is more rigid than the first end.

15. The biological liquid container of claim 14, wherein the nozzle includes a proximal end with respect to the body and a distal end with respect to the proximal end and wherein the proximal end is attached to the second end and is in communication with the cavity so as to be able to selectively dispense the biological liquid.

16. The biological liquid container of claim 15, wherein the nozzle tapers to ensure the artificial insemination device snugly fits onto the nozzle and properly seals when pushed up against at least one of the two bumps.

17. The biological liquid container of claim 16, wherein the tab is an elongate piece of plastic that is coupled to the tapered end of the body and is parallel to the nozzle.

18. The biological liquid container of claim 17, wherein the body is selectively compressible at the first end so as to deliver the biological liquid from the cavity to the artificial insemination device under pressure via the nozzle, and the tapered second end has ridges molded therein to provide additional rigidity.

* * * * *